United States Patent [19]

Dieckow

[11] 4,426,035

[45] Jan. 17, 1984

[54] PACKAGING

[75] Inventor: Klaus-Peter Dieckow, Unionville, Canada

[73] Assignee: Hammex Machines Ltd., Markham, Canada

[21] Appl. No.: 242,321

[22] Filed: Mar. 10, 1981

[30] Foreign Application Priority Data

Mar. 13, 1980 [GB] United Kingdom ..... 800836

[51] Int. Cl.[3] ..... B65D 77/14; B65D 77/30

[52] U.S. Cl. ..... 206/526; 53/412; 53/415; 53/482; 156/198; 156/227; 156/267; 156/289; 156/297; 156/308.4; 493/212; 493/923; 383/89; 206/632; 206/633

[58] Field of Search ..... 206/621, 632, 633, 459; 229/62; 53/412, 482, 415; 493/212, 923; 156/152, 308.4, 198, 227, 267, 289, 297; 150/3

[56] References Cited

U.S. PATENT DOCUMENTS

| | | | |
|---|---|---|---|
| 2,093,979 | 9/1937 | Farmer | 206/632 X |
| 2,226,943 | 12/1940 | Poppe | 229/62 X |
| 2,262,111 | 11/1941 | Moore | 206/632 X |
| 2,400,406 | 5/1946 | Godoy | 206/632 X |
| 2,433,056 | 12/1947 | Masci | 53/482 X |
| 3,057,471 | 10/1962 | Stonehill et al. | 206/632 X |
| 3,212,698 | 10/1965 | Balcom | 229/62 |
| 3,396,902 | 8/1968 | Kilgore | 229/62 |
| 3,439,468 | 4/1969 | Bok | 53/412 |
| 3,439,866 | 4/1969 | Kuhnle | 229/62 |
| 3,531,908 | 10/1970 | Rausing et al. | 53/412 X |
| 3,545,668 | 12/1970 | Hultberg | 229/65 |
| 3,680,771 | 8/1972 | Blunsdon | 229/65 |
| 4,066,167 | 1/1978 | Hanna et al. | 229/62 X |

FOREIGN PATENT DOCUMENTS

| | | | |
|---|---|---|---|
| 1028489 | 4/1958 | Fed. Rep. of Germany | 229/62 |
| 393199 | 6/1933 | United Kingdom | 229/48 SB |
| 916266 | 2/1961 | United Kingdom . | |
| 1234573 | 6/1971 | United Kingdom . | |
| 1470786 | 4/1977 | United Kingdom | 229/62 |

*Primary Examiner*—William I. Price
*Assistant Examiner*—Gary E. Elkins
*Attorney, Agent, or Firm*—Ridout & Maybee

[57] ABSTRACT

A recloseable bag package is provided by closing the top of a filled bag to form a neck, preferably trimming the walls of the bag to the same height, folding over a portion of the neck, preferably only once, and sealing the folded over portion of the neck to a side wall of the bag using a composite tape comprising a length of a first tape having a non-setting adhesive coating on one surface and a length of a second tape overlapping one edge of the adhesive coated surface of the first tape. The first tape seals or reseals the bag, and the second tape provides a tab for peeling the first tape partially from the bag to open the package and also provides a vehicle for coupons or other printed matter. Apparatus is provided to close, trim and fold the bag and to form and apply the lengths of composite tape.

10 Claims, 12 Drawing Figures

PACKAGING

FIELD OF THE INVENTION

This invention relates to a method and apparatus for the closing and sealing of packages using adhesive tape, and to a novel package produced thereby.

BACKGROUND OF THE INVENTION

A number of products are commonly sold in bags, usually of paper, with a closure at their upper end. In many cases, where the contents of the package are used gradually and may deteriorate if exposed to the atmosphere for prolonged periods, it is desirable to make provision for reclosure of the package once opened. A number of proposals have been made for reclosable bags of one sort or another, the most widely used package of this type having a tin tie attached to one edge of the open top end of the bag, which may be closed and reclosed by repeatedly folding the bag end and securing the folds with the tin tie. This form of package has several disadvantages. Firstly, original closure of the packages must either be carried out manually, which is slow and labour intensive, or by the use of very expensive and complicated machinery. Secondly, the tin ties have a metal content, which may interfere with the operation of metal detectors used to detect foreign bodies in the product being packaged and is objectionable if the paper of the bag is incinerated or recycled. Thirdly, reclosure of the package requires a certain amount of care if it is to be effective. Although the tin tie can be applied to the bag automatically during manufacture, and the bags can then be closed automatically, such automation is complex and expensive, and is not economically feasible in many instances. Additionally, the tin tie adds significantly to the cost of the bag.

An example of a bag incorporating a tin tie is shown in U.S. Pat. No. 3,545,668 (Hultberg), which is cited as exemplary of prior art relating to tin tie bags.

Various attempts have been made to find alternatives to the use of tin ties in a reclosable package. One time-honoured approach is to use a separable clip to hold the folded top of the bag closed, an example of such a closure being shown in U.S. Pat. No. 3,680,771 (Blunston). Such clips have the disadvantage of being expensive, separable from the container and therefore subject to loss, and are also in general only easily applied to containers made from fairly stiff material.

Various proposals have been made for th use of non-setting adhesives to produce reclosable packages. U.S. Pat. No. 3,212,698 (Balcom) shows a bag with an adhesive sealing tab and a further non-setting adhesive coating to render the bag reclosable. Other proposals, such as that contained in U.S. Pat. No. 4,066,167 (Hanna et al), have provided a sealing strip attached to the bag which may be used to reseal the container after its original seal has been broken or removed. This of course complicates manufacture of the bag, and is rather clumsy in use since it requires the user to recover the strip from the bag and then apply it.

A further problem in the use of adhesive tape for sealing such bags is that, without tedious multiple folding of the top of the bag, it is difficult to produce a reasonably air-tight seal. U.S. Pat. No. 3,396,902 shows how the top of a bag may be specially shaped so as to ensure that a sealing strip does provide a good seal, but this proposal requires a special configuration of the top of the bag to ensure that all of the bag surfaces are exposed to the sealing strip.

A further feature which it is difficult to incorporate into known forms of bag is the distribution of promotional material such as coupons, or the application of other information which requres to be applied at the time of packaging, such as packaging or expiry dates. U.S. Pat. No. 3,439,866 (Kuhnle) discloses a bag closure arrangement in which a coupon or other material is folded into the neck of the bag during closure, for which purpose pressure sensitive adhesive may be utilized. A disadvantage of this arrangement is that the coupon must be inserted as a separate step, the coupon is not visible until the package is opened, and the closure methods described fall in the categories already discussed above. The Kuhnle arrangement does not provide any solution to the problem of applying packaging and like dates or codes, which hitherto have required the use of an additional printing or labelling step.

SUMMARY OF THE INVENTION

An object of the present invention is to provide an improved reclosable bag package, and apparatus to produce such a package, which does not require the use of a special design of bag, which can be carried out at high speed, and which can readily be utilized to incorporate into the finished package printed material such as coupons or packaging dates or codes. It is a further object of the invention to provide a package which can be made particularly easy to reseal yet satisfactorily airtight and easily produced in an automated operation without the use of expensive clips or tin ties.

According to the invention, a package is formed by the steps of closing an open-topped bag filled with product by bringing together the upper portions of opposite side wall of the bag to form a closed upstanding neck, folding over the neck horizontally at least once, and applying to the folded over portion of the neck and to the adjacent side wall of the bag beneath the fold both a first strip extending parallel to the fold and bearing on its surface adjacent the bag a non-setting adhesive and a second non-adhesive coated strip extending parallel to the first strip and at least partiall beneath and adhered to one lateral edge portion of said first strip to prevent the adherence of the adhesive coated strip to the bag along that edge and to provide a tab whereby the portion of the first strip adjacent the second strip may be peeled from the one of the walls and the folded over portion to which it adheres. Normally the second strip is introduced beneath the lower edge of the first strip and the strips are coterminous and extend the width of the bag.

The second strip, since it provides a tab by which that portion of the adhesive strip adhering, preferably, to the bag wall may be pulled away therefrom, permits simple opening of the package, and this second strip may carry printed material such as a coupon and/or packaging data. The detached portion of the first adhesive strip is readily pressed back into place to reclose the bag.

Preferably, the closed top of the bag is trimmed to a predetermined level after closure, whereby upon folding of the top of the bag, the cut edges become vertically displaced relative to one another, thus exposing each layer of the bag material to the adhesive strip and ensuring a proper seal.

The invention also extends to a reclosable package comprising a filled bag formed at one end with a bag neck in which the bag walls are brought into parallel juxtaposition, the neck being folded upon itself at least once and a folded over portion of the neck being secured to the adjacent wall of the bag, wherein the securement is provided by closure strip means extending parallel to the width of the folded over portion, the closure strip means comprising a first flexible strip coated on one surface with a non-setting adhesive and a second flexible strip without a non-setting adhesive coating overlapping with and adhered to one marginal edge portion of the adhesive coated surface of the first strip, the other marginal edge portion and an intermediate portion of an intermediate portion of the adjesive coated surface of the first strip being adhered to the base, one to the folded over portion of the neck and the other to a portion of the adjacent wall of the bag not overlaid by said folded over portion.

The invention also extends to apparatus for forming a reclosable packaged from a filled open-topped bag, comprising means to transport successive bags along a path sequentially through a plurality of operating stations, said operating stations comprising in sequence a closing station having means to bring the bag walls of the open end of the bag into parallel juxtaposition to form a closed upstanding neck, a folding station comprising means to fold the neck upon itself at least once, and a sealing station comprising means to dispense a first tape having a nonsetting adhesive coating on one surface and a second tape without such a coating, means to sever strips of said tape, and means to apply said strips to the bag neck with one edge of the second strip overlapping one marginal edge portion of the adhesive coated surface of the first strip and the remainder of the adhesive coated surface of the first strip adhered both to said folded over portion of the neck and an adjacent side wall of the bag.

Further features of the invention will become apparent from the following description of a preferred embodiment with reference to the accompanying drawngs.

SHORT DESCRIPTION OF THE DRAWINGS

Figures 7, 8, 9:
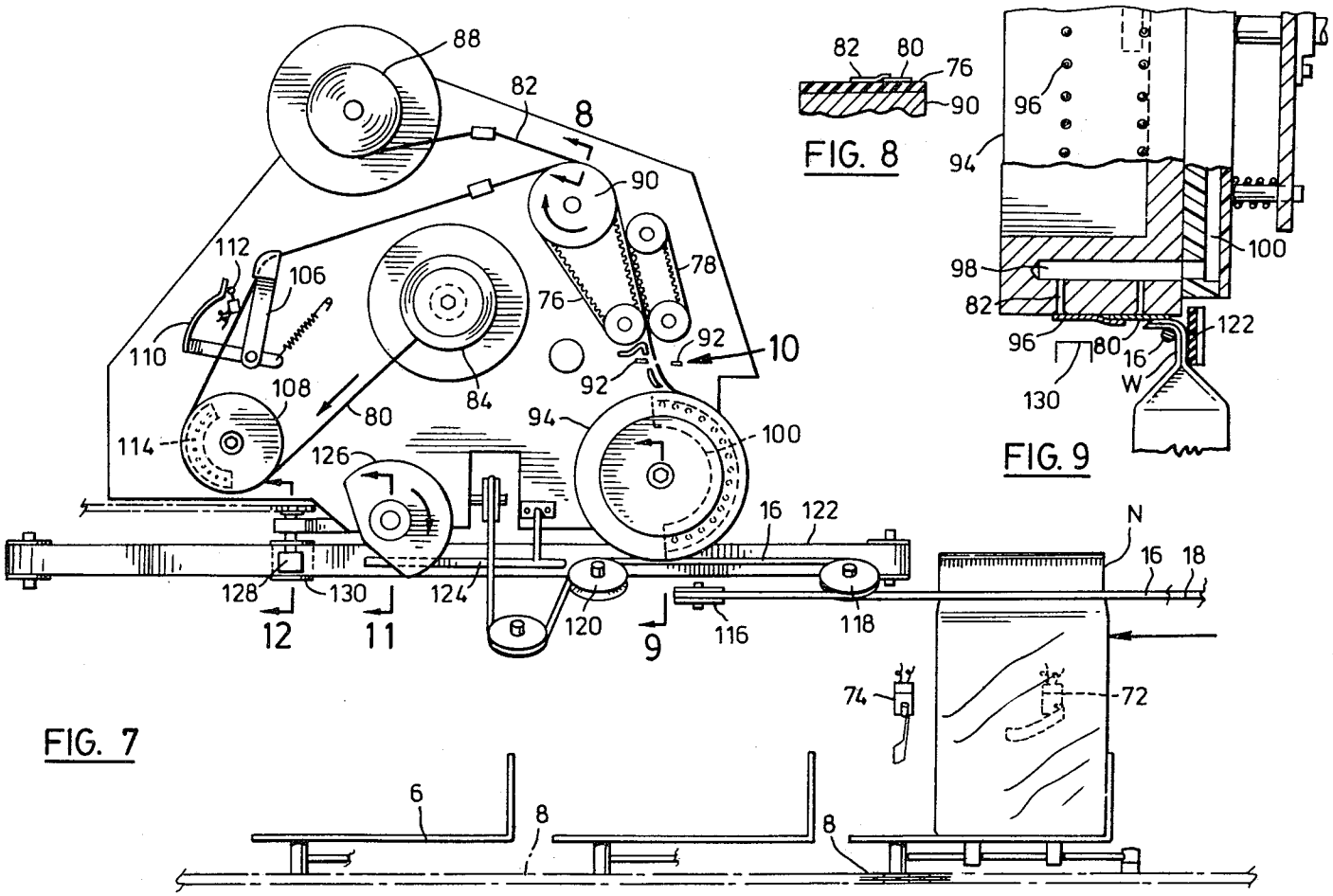
FIG. 7 is a fragmentary elevation of part of the apparatus, illustrating the application of lengths of tape to a bag.
Figure 10:
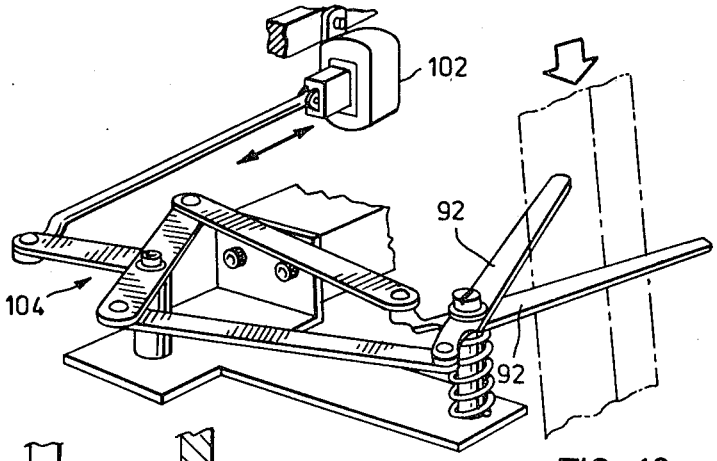

FIGS. 8, 9, 11 and 12 are fragmentary sections upon the lines 8—8, 9—9, 11—11 and 12—12 in FIG. 7; and FIG. 10 is a fragmentary perspective view from the direction of the arrow 10 in FIG. 7.

DESCRIPTION OF THE PREFERRED EMBODIMENT

Features of the package and package sealing method of the invention will best be understood by description of the operation of an embodiment of apparatus in accordance with the invention. The principal features of this apparatus are seen in the schematic diagram of FIG. 1, whilst certain features of the invention are described in more detail with reference to the remaining Figures.

Figure 1:
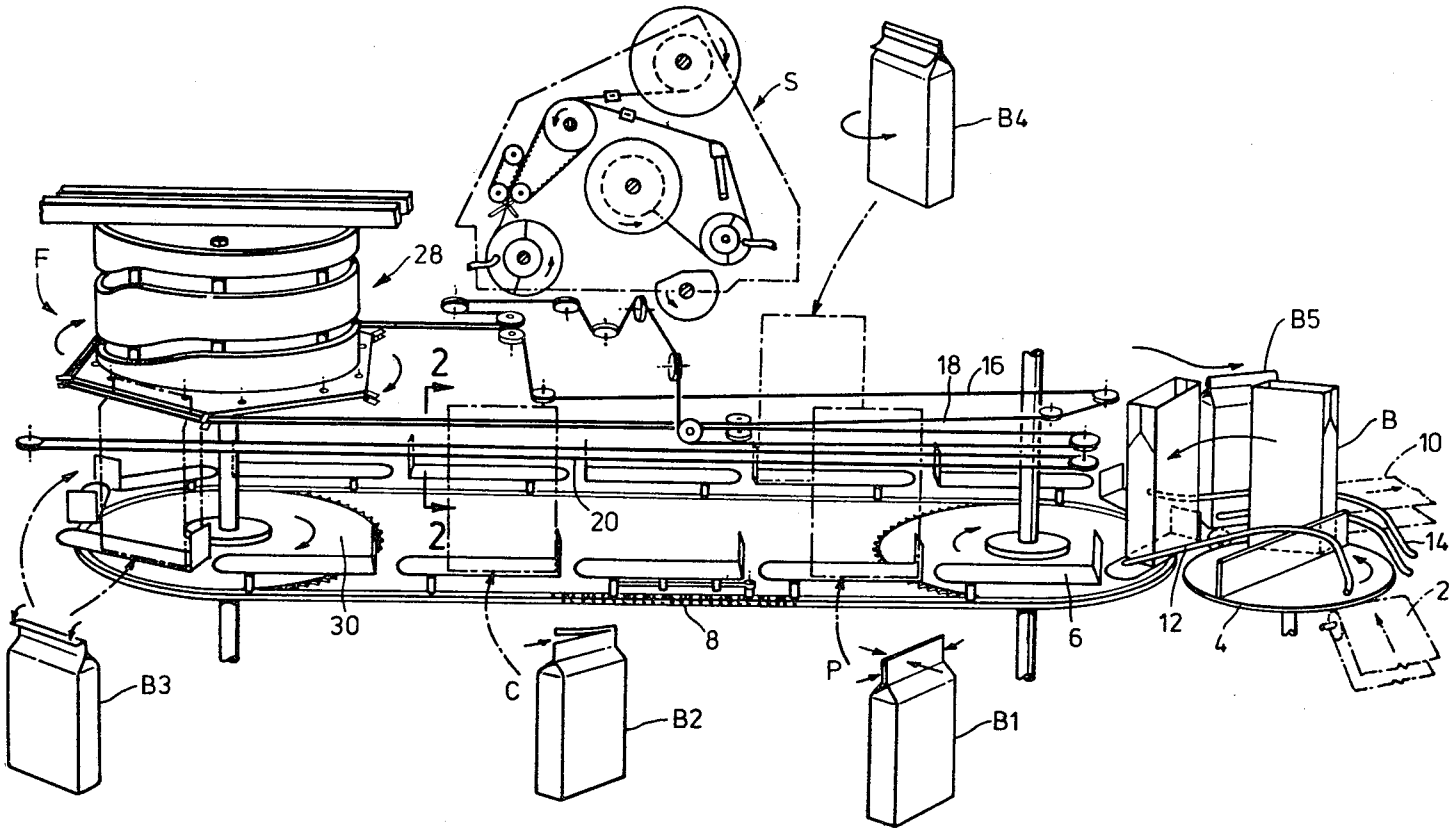
FIG. 1 is a simplified perspective schematic diagram of apparatus for implementing the method of the invention, also including views of a packing at various stages in the implementation of the method of the invention.

Referring to FIG. 1, open bags B filled to a desired level with a product, such as cookies, coffee or pet food, are delivered by a conveyor 2 and a turntable 4 to successive carriers 6 mounted on an endless chain 8 driven along an oval path through a pleating station P, a cutting station C, a folding station F and a sealing station S, whereafter the sealed bag packages B5 are discharged onto a conveyor 10. Loading of the bags B is effected by synchronized movement of the turntable 4 in conjunction with rails 12, whilst further rails 14 guide the sealed packages B5 off the carriers onto the conveyor 10. In order better to illustrate the progress of the closing operation, FIG. 1 includes perspective views showing packages B1, B2, B3 and B4 at the stations P, C, F and S.

Figure 3:
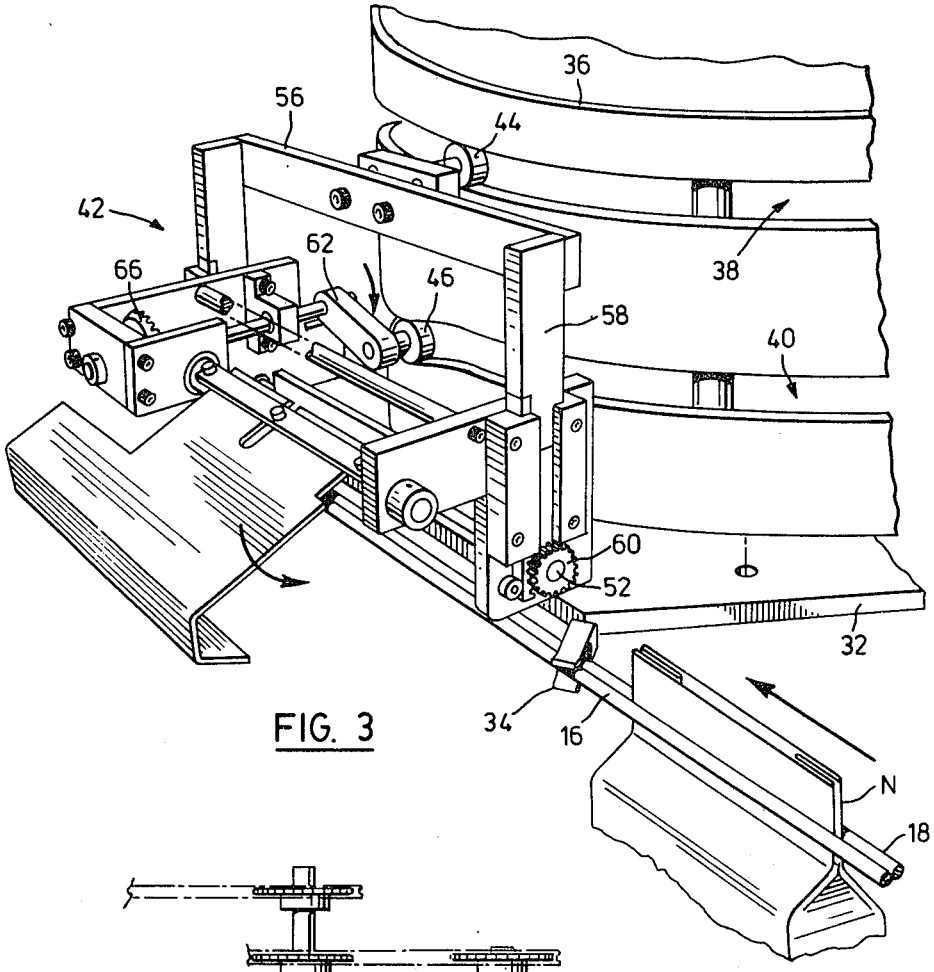
FIG. 3 is a fragmentary perspective view illustrating a first stage in the folding of the top of a bag.
Figure 2:
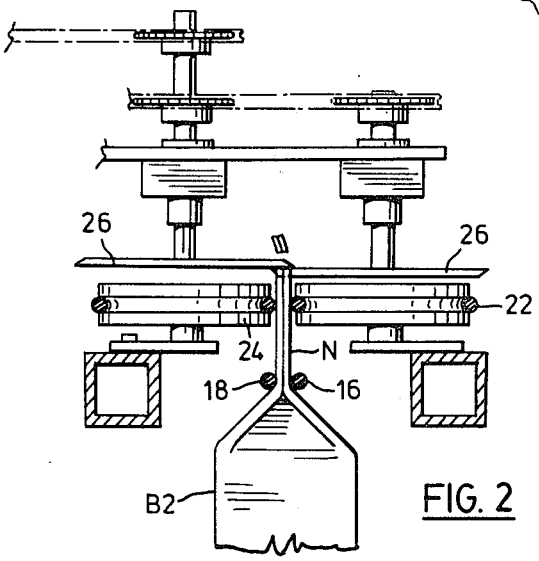
FIG. 2 is a fragmentary section illustrating the trimming of the top of a closed bag.

As the packages pass through the station P, they are acted on by two pairs of folding plates (not shown) which fold inwards the upper portions of the end walls of the package whilst pressing inwards the side walls, as indicated by the arrows around the top of package B1. It will be understood that this pleating operation could be carried out by any mechanism suitable for the purpose, suitably synchronized to the operation of the chain 8. In order to maintain the top of the package in the pleated and closed condition illustrated by package B1, the moving package upon leaving the pleating station is gripped at its neck between a pair of endless rubber guide belts 16 and 18 driven at the same rate as the chain 8 so as to travel therewith and grip the package as best seen in FIGS. 2 and 3. An additional belt 20 bears against the outer sides of the packages to help steady them in their progress through stations P and C. At station C, and as best seen in FIG. 2, the top portion or neck N of the bag is gripped between rubber O-rings 22 on spring loaded idler rollers 24 which guide the top of the neck N into the nip of two interengaging cutting discs 26. The discs shear off the top of the bag horizontally so that all of the top edges of the bag are at the same level as the bag enters the folding station F.

The folding station F is located peripherally of a carousel rotating on the same axis and at the same rate as a sprocket 30 engaging and supporting one end of the chain 8. The carousel 28 comprises a polygonal plate 32 carrying at its corners guides 34 for the belts 16 and 18, and is concentric with a stationary cam drum 36 defining two peripheral cam tracks 38 and 40. Between each pair of guides 34, the plate 32 supports a folding mechanism 42 operated by cam followers 44, 46 engaging the cam tracks 38 and 40 so that the vertical undulations of the tracks are translated into movements of folding members 48 and 50 about the axes of shafts 52 and 54. More specifically, and as best seen in FIGS. 3, 4 and 5, movement of the follower 44 is transmitted via a cross bar 56, racks 58 and pinnions 60 to the shaft 52, whilst movements of the follower 46 are transmitted via the crank 62, the shaft 64 and the bevel gears 66 and 68 to the shaft 54.

Figure 4:
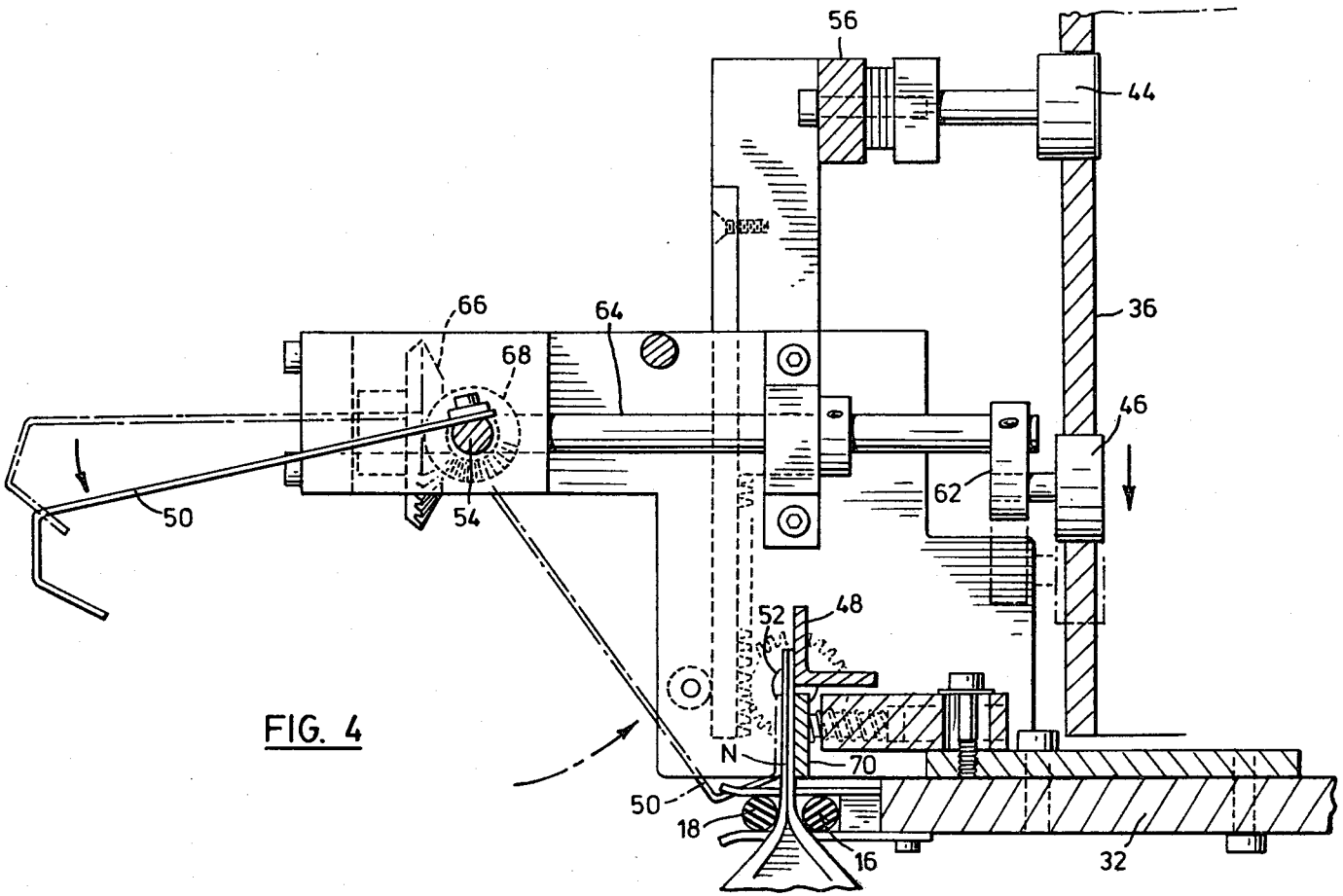
FIGS. 4, 5 and 6 are fragmentary sections illustrating further stages in the folding of the top of a bag.
Figures 5, 6:
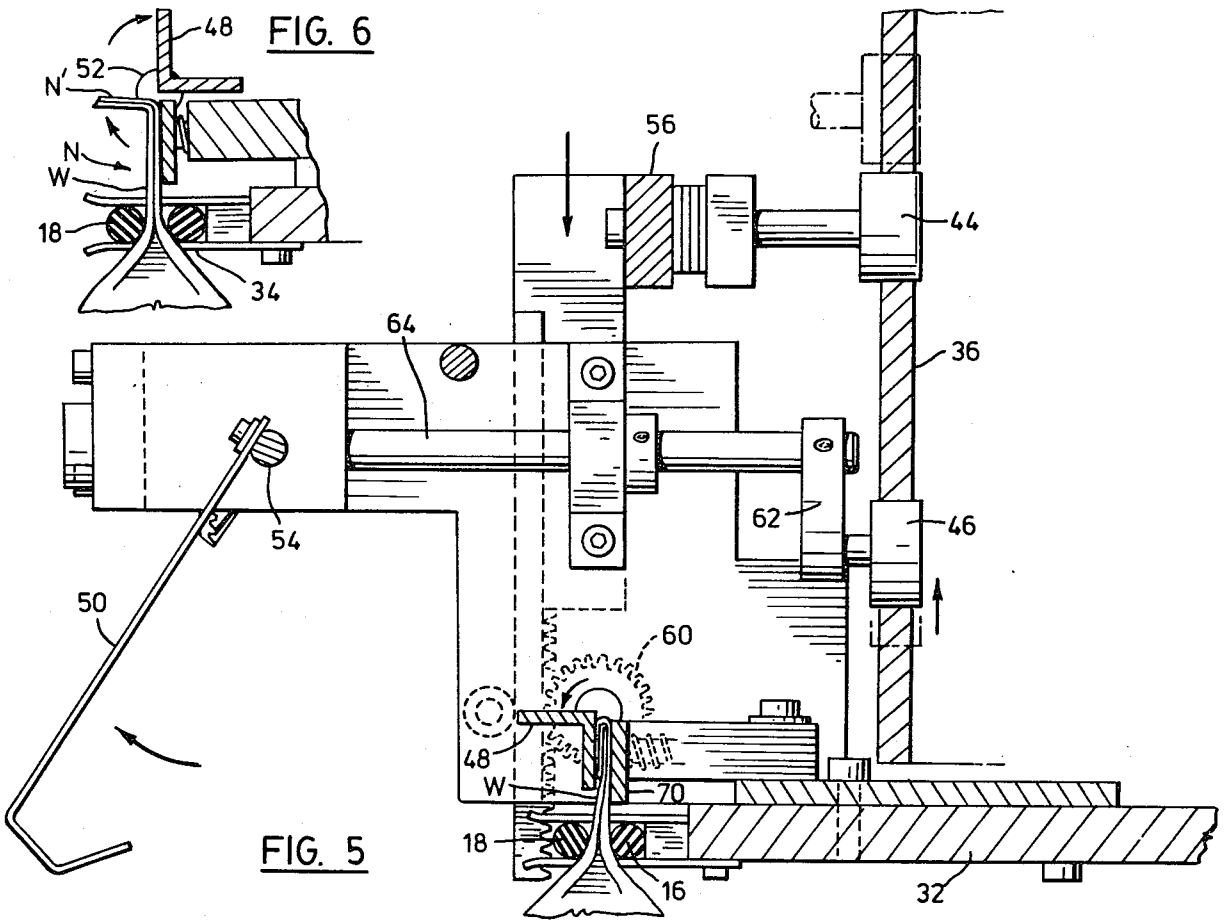

Successive operations resulting in the container B3 at the folding station F are illustrated in FIGS. 4, 5 and 6. As a package enters the folding station, the folder members 48 and 50 start in the positions shown in FIG. 3 and in solid lines in FIG. 4. The member 50 then descends to the lower position shown in broken lines so that a turned up end portion holds the neck N of the bag against a spring loaded platen 70 whereupon the member 48 rotates anticlockwise from its position shown in FIG. 4 so as to fold the top of the neck over the end portion of the member 50. The member 48 then moves clockwise sufficiently to enable the member 50 to disengage from the neck and withdraw to its original position, whereupon the member 48 once again moves anticlockwise to the position shown in FIG. 5 so that the top portion of the neck is tightly folded against the adjacent side wall W of the bag in the still upstanding portion of the neck N so as to form a sharp crease. Since the material of the bag is of finite thickness, and the pleats inserted at the pleating station P result in most of the neck having four thicknesses of paper, the folding will result in the originally adjacent cut edges produced at the cutting station C no longer being immediately adjacent. Instead, they will be fanned slightly apart as seen in FIG. 5 and subsequent Figures. This has a significance discussed further below.

Before the package leaves the folding station F, the folding bar 48 retracts clockwise to its original position, allowing the creased top end N′ of the package neck to spring back as shown in FIG. 6.

The package next approaches the sealing station S, shown in more detail in FIG. 7. The neck N of the package is still at this point gripped between the belts 16 and 18. On approaching the station, the package engages sequentially two switches 72 and 74, which may be operated by feelers as shown, or by photoelectric means. The switch 72 applies drive to sprockets driving two internally toothed belts 76 and 78 which advance a composite sealing strip formed by a pair of tapes 80 and 82 drawn from rolls 84 and 88. Both tapes pass around part of the periphery of a sprocket 90 supporting the belt 76, this portion of the periphery being shown in section in FIG. 8. The tape 80 carries a non-setting adhesive upon its outer surface as seen in FIG. 8, and the tape 82 is fed onto the surface of belt 76 on sprocket 90 so that it overlaps the adhesive surface of tape 80 and adheres thereto to form the composite strip. The belt 78 is narrower than the belt 76, and is disposed so as only to bear on the non-adhesive tape 82, thus enabling the combined tapes to be pinched between the belts and advanced without any contact with the adhesive surface of tape 80. Upon emerging from between the belts, the combined tapes are fed between the blades 92 of a shear and onto the surface of a roller 94 driven so that its peripheral speed is the same as that of the chain 8. As best seen in FIG. 9, the roller 94 has on its peripheral surface a number of small orifices 96 connected by drillings 98 to a stationary semicircular vacuum manifold 100, so that suction forces are developed at the surface of the roller on its right hand side as seen in FIG. 7. The combined tapes are thus drawn onto the surface of the roll 94 and are transported downwardly. When the package reaches the switch 74, drive to belts 76 and 78 is interupted, and a solenoid 102 (see FIG. 10) is energized. The solenoid operates through a linkage 104 to actuate the shear blades 92 and sever the combined tape.

In order to draw tape from the roll 84, the tape path is arranged so that it passes around a roller 108 and a tension arm 106. As tape is advanced by the belts 76 and 78, it is drawn from the loop formed by the tension arm 106 until a feeler 110 operates a limit switch 112 which in turn applies drive to the roller 108. The roller 108 is of similar construction to roller 94, with a vacuum manifold 114, and so that the non-adhesive side of the tape is sucked against the roller, and further tape is drawn from the roll 84 as the roller 108 rotates, so as to replenish the loop formed by the arm 106.

Figure 11:
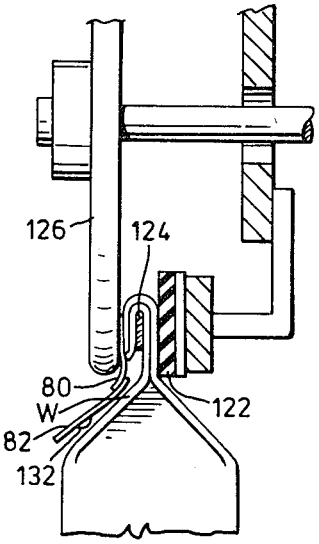
Figure 12:
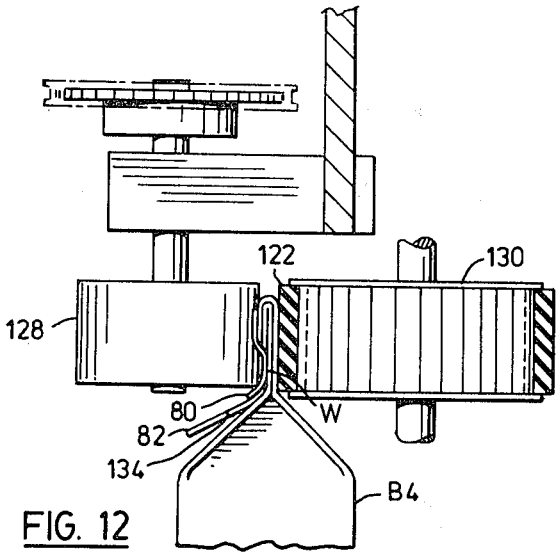

The belt 16 passes around a pulley 116 beneath the roller 94 and then around further pulleys 118 and 120 to raise its level so that a portion of the belt presses the creased over portion N′ of the neck of the package towards the bottom of roller 94 as shown in FIG. 9. The upright portion of the neck N is supported by a further belt 122 driven parallel to the chain 8 at the same speed and engaging the side wall of the bag further from the neck portion N′. Thus as the severed portions of the tapes 80 and 82 travel around the periphery of the roller 94, the outer edge of the adhesive coated side of the tape 80 is applied to the top surface of the folded over portion N′ of the neck and adheres thereto. Since the vacuum manifold 100 ends just short of bottom centre of the roller 94, the tape is released from the roller as it adheres to the package. As the package advances further, the upstanding portion of the neck passes between the belt 122 and a guide blade 124, and the creased over portion of the neck is then turned down by a rotating cam 126 as best seen in FIG. 11. As the package passes beyond the end of the blade 124, a pressure roller 128 forms a nip with a roller 130 supporting the belt 122 (see FIG. 12) so as to press the tape 80 firmly into contact not only with the bent over portion N′, but also the adjacent side wall W of the bag on the upstanding portion of the neck N, and intermediately the separated cut edges of the various layers of the bag as seen in FIG. 12. It will of course be appreciated that the thicknesses of the bag layers in the various figures have been greatly exaggerated for the sake of illustration and thus the tape is quite readily brought into contact with and adheres to the various layers. The package B4 thus formed is then further advanced on its carrier 6 and discharged onto the conveyor 10.

As can be seen best from FIGS. 1 and 12, the completed package has a single fold at its neck N, secured and sealed by the tape 80. The upper edge of the tape 82 extends beneath the lower edge of the tape 80, so that the tape 82 is secured to the tape 80, and the lower edge of the tape 80 is not secured to the bag. The tape 82 may thus be used as a tab to lift the lower part of the tape 80 away from the neck of the bag, thus releasing the creased over portion N of the neck and allowing the bag to be opened. The bag may be resealed simply by folding over the portion N′ of the neck and pressing the lower portion of the tape 80 back into contact with the neck of the bag.

The tape 82 not only serves to facilitate opening and reclosure of the bag, but may also advantageously be used for various other purposes. Firstly, it may be used to carrying packaging dates and codes, which may either be preprinted on the tape or applied by a suitable printing head positioned at an appropriate point along the tape path at station F. Secondly, the tape may be formed as a strip of coupons, which are thereby automatically applied to the packages. In this case, the tape 82 may be formed with a longitudinal perforation 134 or other line of weakness so that a coupon portion may be removed from the package and still leave a tab for opening the package.

The tape 82 may further serve to provide a virgin seal on the package. To this end, a gluing head 130 may be provided, for example beneath the roller 94 (see FIG. 9), to apply a row of dots or other pattern of hot melt adhesive 132 (see FIG. 11) to the underside of the tape 82 so that the latter is locally adhered to the shoulder of the package B4 to provide a seal which must be broken before the package can be opened.

Although the operations described give rise to a package with an upstanding neck, it will of course be understood that an additional operation could be introduced to fold down the neck against a shoulder of the package, and if necessary adhere it lightly thereto.

As will be apparent from the foregoing descriptions, the various operations carried out by the apparatus must be properly synchronized to passage of packages through the machine. Conveniently, this is achieved by utilizing positive chain and sprocket or gear drives to maintain synchronism. Only sufficient portions of these drives and of a supporting frame which maintains the proper spacial relationship between the parts of the apparatus, have been illustrated as are necessary for a full understanding of the invention.

Although a specific embodiment of the invention has been described, and represents the best mode known to the inventor of putting the invention into practice, it will be appreciated that a number of the operations involved in producing the package could be carried out by alternative means. As in the case of the pleating operation, the cutting and folding stations could be of different form, and alternative arrangements could be used to dispense the composite tape, due consideration being given to the difficulties involved in handling self-adhesive tape. These problems are considerably facilitated by the present invention in which a non-adhesive tape is used in conjunction with the adhesive tape, since the composite tape will have non-adhesive areas on both sides, thus facilitating handling and permitting the use of such expedients as the co-acting drive belts 76 and 78 acting on opposite sides of the tape. The vacuum rollers 94 and 108 also permit advance of an adhesive tape with contact only being made with its non-adhesive surface. An alternative mode of advancing such adhesive tape into engagement with a package involves advancing the tape along a trough so that it assumes a laterally curved configuration in which it is to a degree self-supporting, the drive force being applied to the adhesive side of the tape by adhesive drive rollers.

Although in the preferred embodiment of the invention, the neck of the bag is folded once, a similar tape seal may be applied to multiple folded bag necks although in this case the top edges of the bag will not be directly engaged by the tape. The non-adhesive tape could also be overlapped beneath the top edge rather than the bottom edge of the adhesive tape although this arrangement will usually be less satisfactory since on opening the tape will remain adhered to the main portion of the bag neck and will not assist in unfolding of the folded over portion of the bag neck. This unfolding facilitates opening of the bag since it automatically tends to limit the extent to which the tape is pulled away from the bag during opening.

Orientations are described in the above description and following claims on the basis that the packages are processed with the initially open end of the bags facing upwards. Whilst this orientation will normally be the most practicable, it should be understood that where the bags and their contents can be handled in alternative orientations, such alternative orientations are intended to be comprised within the scope of the invention.

When reference is made to the strip 82 being non-adhesive or non-adhesive coated, this is intended to refer to non-setting adhesive coatings such as that applied to the tape 82. It is not intended to rule out the application of setting adhesive, e.g. the hot melt adhesive 132, which does not interfere with the application of the tape 82 during closure of the package nor prevent the tape 82 from being used as a tab to open the package.

What I claim is:

1. A method of forming a reclosable package, comprising the steps of closing an open-topped bag filled with product by bringing together upper portions of opposite side walls at a top of the bag to form a closed upstanding neck, forming at least one horizontal fold in the neck to form a folded over portion of the top of the bag overlying a portion of a side wall of the bag, and applying to the folded over portion and to said side wall of the bag adjacent its overlaid portion a closure substantially longitudinally coextensive with the folded over portion, said closure comprising both a first flexible strip, extending parallel to the folded over portion and having parallel portions of one surface applied to the folded over portion and to said side wall, said surface being coated with a non-setting adhesive, and a longitudinally coextensive second flexible strip, without a non-setting adhesive coating and extending parallel to the first strip, said second strip being at least partially overlapped by and adhered to one lateral edge portion of the adhesive bearing surface of the first strip to prevent adherence of the first strip to said side wall along that edge and to provide a tab whereby the portion of the first strip adjacent the second strip and applied to the side wall may be peeled from the latter.

2. A method according to claim 1, wherein the top edges of the upper wall portions of the bag are trimmed to a uniform height after being brought together, and only one fold is formed in the neck causing the different cut edges of the bag to become fanned out and exposed to the adhesive on the adhesive coated strip.

3. A method according to claim 2, wherein the neck is first folded over a folding member, the folding member is withdrawn, the fold so produced is then compressed to produce a sharp crease and released, the second strip is applied to the adhesive coated surface of the first strip, a portion of the latter surface is applied to the folded over portion, and the strip and the folded over portion are then pressed against the adjacent side wall.

4. A method according to claim 1, 2 or 3, wherein one edge portion of a continuous strip without a non-setting adhesive coating is applied to one edge of a surface of a continuous strip having a non-setting adhesive coating on that surface, to form a combined strip, the combined strip is advanced by applying drive means to opposite sides of the lap between the strips, and a length of the combined strip is severed for application to the bag.

5. A method according to claim 1, 2 or 3, wherein the non-adhesive coated strip is adhered by spots of setting adhesive to the adjacent side wall of the bag to form a virgin seal.

6. A reclosable package comprising a filled bag formed at a top end with a bag neck in which side walls of the bag are brought into parallel juxtaposition, the neck being formed with at least one fold such that a folded over portion of the top of the bag overlies a portion of one of its side walls, and closure strip means extending parallel to the width of and substantially coextensive with the folded over portion, the closure strip means comprising a first flexible strip coated on one surface with a non-setting adhesive and a second flexible strip, without a non-setting adhesive coating and overlapped by and adhered to one marginal edge portion of the adhesive coated surface of the first strip, the other marginal portion and an intermediate portion of the adhesive coated surface of the first strip being adhered respectively to the folded over portion of the neck and to an adjacent portion of said side wall of the bag not overlaid by said folded over portion.

7. A package according to claim 6, wherein the bag walls of the neck when unfolded all have the same height, and the neck is formed with only one fold whereby top edges of the walls are fanned slightly apart and adhered to said adhesive coated surface of the first strip.

8. A package according to claim 6 or 7, wherein the second strip carries printed matter on its portion not overlapping the first strip.

9. A package according to claim 6 or 7, wherein said second strip incorporates a tear-off coupon portion remote from that edge overlapping the first strip.

10. A package according to claim 6 or 7, wherein said second strip is adhered to said side wall by spots of setting adhesive to form a virgin seal.

* * * * *